United States Patent [19]

Herb

[11] Patent Number: 4,690,396

[45] Date of Patent: Sep. 1, 1987

[54] DELIVERY DEVICE

[75] Inventor: Rudolf Herb, Bobenheim, Fed. Rep. of Germany

[73] Assignee: Albert-Frankenthal AG, Frankenthal, Fed. Rep. of Germany

[21] Appl. No.: 851,801

[22] Filed: Apr. 14, 1986

[30] Foreign Application Priority Data

Apr. 27, 1985 [DE] Fed. Rep. of Germany ..... 3515328

[51] Int. Cl.[4] ..... B65H 29/54

[52] U.S. Cl. ..... 271/311; 271/187; 271/188; 271/315

[58] Field of Search ..... 271/187, 315, 209, 188, 271/307, 311, 306

[56] References Cited

U.S. PATENT DOCUMENTS

| | | | |
|---|---|---|---|
| 953,045 | 3/1910 | Main | 271/188 |
| 1,325,550 | 12/1919 | Wood | 271/315 |
| 3,847,384 | 11/1974 | Bethke | 271/187 X |
| 4,445,681 | 5/1984 | Reist | 271/188 X |
| 4,487,408 | 12/1984 | Fischer | 271/187 X |

*Primary Examiner*—Richard A. Schacher

*Attorney, Agent, or Firm*—Collard, Roe & Galgano

[57] ABSTRACT

A delivery device comprising at least one conveyor belt defining a conveying plane arranged under a fan wheel to receive products from the fan wheel more especially in the form of an overlapping stream. The device has at least one elongated and raised member that is aligned with the direction of delivery and which slopes downwards from a higher level than the conveying plane on the conveying belt in the direction of delivery and at its front end has an edge that adjoins the conveying plane on the conveying belt side.

15 Claims, 2 Drawing Figures

DELIVERY DEVICE

BACKGROUND OF THE INVENTION

The invention relates generally to printing machinery and more specifically to a delivery device comprising at least one conveyor belt defining a conveying plane arranged under a fan wheel to receive products from the fan wheel more especially in the form of an overlapping stream.

Known arrangements of this sort are designed to deposit the products onto the conveyor belt moving through under the fan wheel. In this case there is then the danger that the products may slide on the conveyor belt and become disordered, an effect that is more particularly caused by an air cushion formed under the products as they are deposited on the belt. The consequence is that the products will not assume the desired position on the conveyor belt and instead will be displaced in the direction of delivery and transversely thereto. Such irregular alignment athwart the delivery direction may admittedly be corrected by lateral plungers, but devices of this kind make a sizeable additon to costs. It is not possible to correct the irregularities in the direction of delivery, that is to say the overlap of the products or the spacing of the overlapping edges later. Exactly regular spacing of the overlapping products is however often required in order to ensure trouble-free operation of product processing devices supplied by the conveyor belt. Therefore, attempts have been made to use moving abutments to produce regular spacing of the overlapping products, but devices of this sort are again very complex and quite apart from such complexity there is a tendency for the spacing of the overlapping products to be disturbed by the lateral plungers.

SHORT SUMMARY OF THE INVENTION

In view of this, one object of the present invention is to avoid the shortcomings of the prior art.

A further aim of the innovation is to devise a device of the initially mentioned type which is of simple design.

A further objective of the invention is to provide such a device which despite its simple construction ensures a precise positioning of the products on the conveyor belt (or the conveyor belts, as the case may be).

In order to achieve these or other aims appearing from the present specification and claims, the device has at least one elongated and raised member that is aligned with the direction of delivery and which slopes downwards from a higher level than the conveying plane on the conveying belt in the direction of delivery and at its front end has an edge that adjoins the conveying plane on the conveying belt side.

The products leaving the fan wheel then abut against the narrow edge of the raised member facing the fan wheel so that they are bent to a greater or lesser extent along a line extending in the direction of delivery, such bending causing the products to be stabilized in the sense that it enables precise guiding of the products along the raised member running in the direction of delivery. Simultaneously, owing to the raised arrangement and the only slight downward slope of the raised member, it is possible to prevent any so-called floating or gliding of the products, that is to say any sort of hovering of the products on an air cushion, so that one is entitled to expect an exact and perfectly regular location of the products not only athwart the delivery direction but also in the delivery direction itself. The above observations will serve to show that the present invention achieves its object with simple and low-cost means.

In accordance with an advantageous further feature of the invention it is possible to have a single centrally located raised elongated member. This leads in practice to the formation of a pronounced groove in the center of the products and despite the simple means employed it ensures a particularly regular positioning and locating effect.

As envisaged by a further feature of the invention, the slope of the upper edge of the raised member may be adjustable. This measure makes possible exact adaptation of the position of the upper edge of the raised member to suit the given length or thickness of the products.

As part of a particularly advantageous form of the invention the raised member is so arranged that its center part is at least at a tangent to the circumference of the fan wheel or preferably fits into the fan wheel, i.e. it is so placed that it overlaps the circumferential outline of the fan wheel. This measure then ensures that the raised member will become operational even while the products are still in the fan wheel. The products are then practically pressed by the fan members of the fan wheel adjacent to the raised member against it, something that ensures a perfectly precise and regular action and location of the products both in the delivery direction and also transversely to it.

In accordance with a further advantageous feature of the invention, the raised member may be in the form of the upper run of a circulatory loop (which runs over two bend members and is preferably power driven) sloping downwards in a forward direction in relation to the conveying plane adjacent to the conveyor belt. With such an arrangement there are only small or neglibible relative movements between the products and the upper run of the loop forming the raised member, this guaranteeing a particularly gentle handling of the products. Such a system furthermore ensures a particularly simple arrangement that is easy to service inasfar as not anti-friction coatings or the like are needed. And owing to the absence of motion of the products in relation to the said raised member there is little wear.

In keeping with a still further, convenient feature of the invention the said loop with the run forming the raised member may be operated with a surface speed that is 1% to 5% less than the speed of the conveying belt or belts. It has been seen from experience that this may well have a beneficial effect on securing and exact location of the products.

As part of a further measure of the invention, the loop constituting the raised member may be flanked by at least two conveying belts and it is trained over a common driving pulley which preferably has a groove for the loop acting as the raised member, and the latter is trained over a rear bend pulley that is independent from rear bend members for the conveying belts and possesses a diameter which is larger than the diameter of the drive pulley. These measures ensure a particularly simple manner of adjustment of the slope of the upper loop run, forming the raised elongated member, of the belt by merely setting the rear bend pulley.

Further expedient features and advantageous outgrowths of the invention will be seen from the ensuing detailed description of one working example thereof as shown in the accompanying drawings.

LIST OF THE SEVERAL VIEWS OF THE DRAWINGS.

DETAILED ACCOUNT OF ONE POSSIBLE EMBODIMENT OF THE INVENTION

Figure 2:
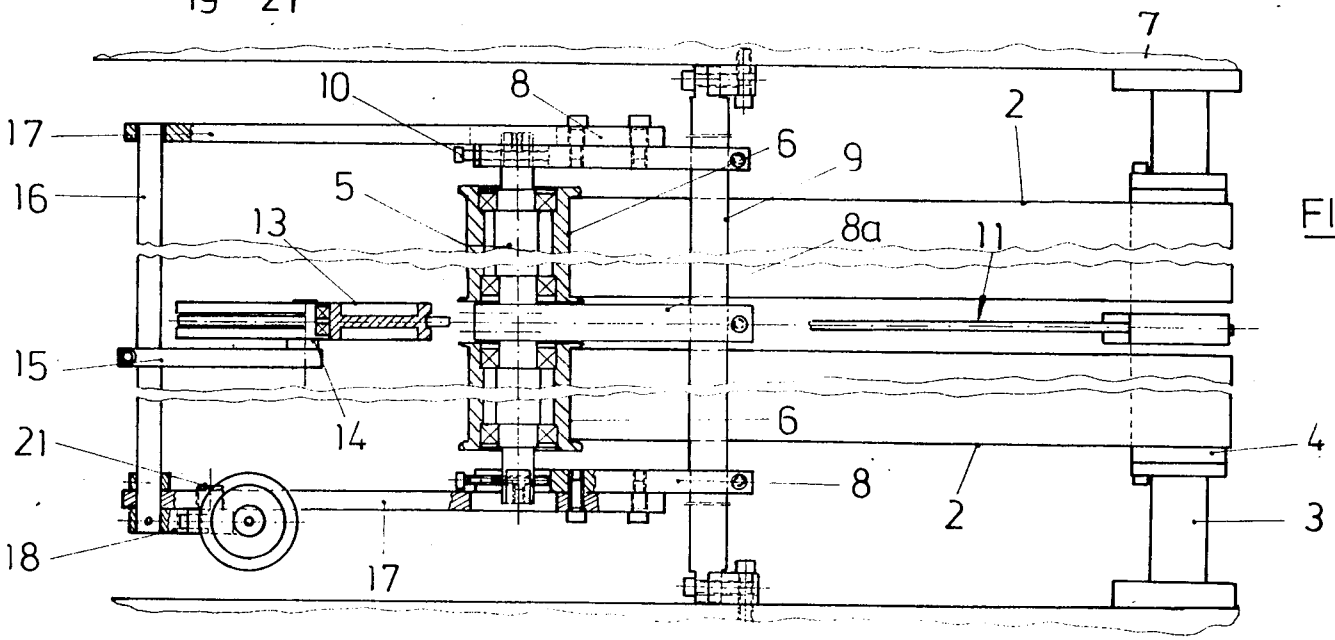
FIG. 2 is a plan view of the delivery system of FIG. 1.

The delivery device to be seen in the figures comprises conveyor belts 2 running in the direction of delivery under a fan wheel 1 with clearance. As will best be seen from FIG. 2, in the present working example it is a question of two comparatively broad, adjacently placed flat conveyor belts with a small average distance between them so that their surfaces facing the fan wheel define a conveying surface. The conveyor belts 2 run around front and rear bend members. To form a front bend member there is in the present case a bend pulley 4 extending right across the full width of the device and coupled with a drive shaft 3. To form the rear bend members there are freely rotating drums 6 which are mounted on a shaft 5 reaching across the full width of the conveyor belts 2. The effective diameter of the driven front bend pulley 4 and the rear bend drums 6 is generally equal so that the lower run of the conveyor belts 2 extends parallel to the respective upper run. The front bend pulley 4 is rotatably carried on the side frames 7 by way of the drive shaft 3 and a bearing pin opposite thereto. The shaft 5 for the rear bend drums 6 has lateral flat pins fitting into slots of lateral bearer links 8, that are clamped on a crosspiece secured to the side frames 7. By turning the bearer links 8 in relation to the crosspiece 9 it is possible for the operator to adjust the distance between the conveying plane as constituted by the conveyor belts 2 and the circumference of the fan wheel. For precise adjustment of the tension of the conveyor belts 2 the flat pins on the shaft for the rear bend drums 6 are supported on the bearer links 8 by screws 10. In the illustrated form of the invention the shaft 5 is supported not only on the lateral bearer links 8 but also on a center bearer link 8*a* also clamped onto the crosspiece 9 in order to avoid sagging of the shaft 5.

Figure 1:
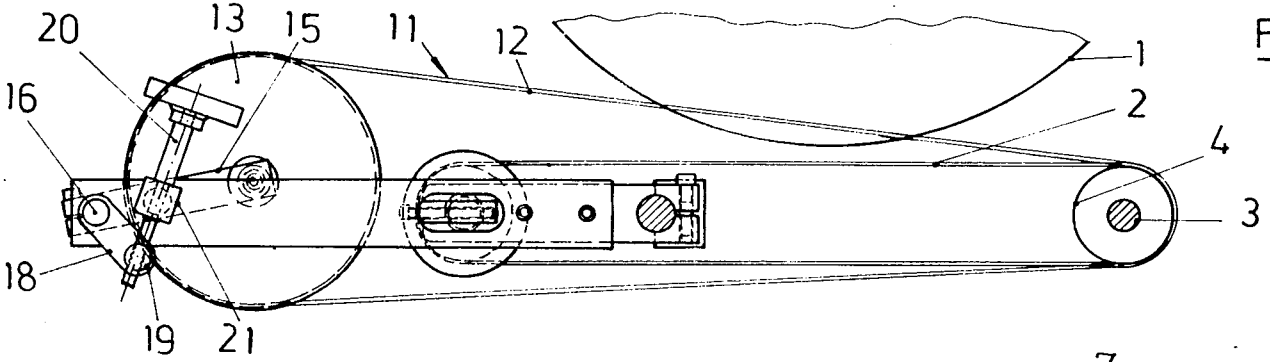
FIG. 1 is a lateral view of one delivery device in accordance with the invention.

In the part between the two lateral conveyor belts 2 there is a centrally arranged elongated raised member 11 extending in the delivery direction so as to be at a higher level than the conveying plane as defined by the conveyor belts 2. The upper edge of this member 11 slopes downwards in the direction of delivery towards the front and its front end runs into the plane of conveyance, as will be readily clear from FIG. 1. In the illustrated working example of the invention there is only the single centrally arranged raised member 11, but it would be quite possible to have more than one such raised member or bridge. The upper edge of the member 11 adjacent the fan wheel is in the present example designed with a straight linearly and downwardly sloping setting.

The folded products deposited on the conveyor belts 2 in an overlapped stream or array by the fan wheel 1 are bent or grooved by the member 11 raised to be at a higher level that the conveyor belts 2 so that the products are not only propelled by the belts 2 but are furthermore kept in the desired positions in relation thereto. The upper edge of the raised member whose vertical spacing form the conveying plane as defined by the conveyor belts 2 decreases in the direction of conveyance, may run past under the fan wheel 1 with a small clearance, or at any rate with smaller clearance than that of the conveyor belts 2, or it may be tangent to the fan wheel 1. In the illustrated working example the upper edge of the raised member 11 extends into the outer circumferential outline or envelope of the fan wheel so that it is between two disks of the fan wheel 1 as formed by fan members and the products deposited from the fan wheel are pressed onto the raised member 11. The level of the upper edge of the raised member, which increases towards the rear, that is to say its slope in relation to the conveying plane, is adjustable so that even when handling different products one may be sure that they will be gently treated.

The raised member 11 may be in the form of a slat having an anti-friction coating as for example in the form of a sheet metal strip or a tubular bridgepiece. In the illustrated example of the invention the raised member 11 is formed by the upper run, which declines towards the front, of a circulatory loop 12. The loop 12 may be in the form of a narrow flat belt, a v-belt or some similar component. In any case the result will be a raised elongated member 11 with an elastic upper edge, a great advantage as regards ensuring gentle handling of the products. The loop 12 is in the form of a continuous loop of belt material so that there is generally speaking no relative motion between the products and the raised member 11 as formed by the upper run of the loop 12. In the illustrated working example of the invention the loop 12 forming the raised elongated member 11 has a positive drive so that one may be certain of a continuous motion and accordingly of very smooth operation in the sense that there is no rough handling of the products. The drive of the loop 12 forming the raised member 11 is in the present case at a surface speed approximately 1% to 5% under the surface speed of the conveyor belts 2, this having been shown to ensure a particularly accurate handling of the products on the conveyor belts 2.

In the present working embodiment of the invention at the front end the loop 12 running into the plane of the conveyor belts 2 is trained around the continuous, driven bend pulley 4 therefor so that there is neat incidence of the upper edge of the raised member into the conveying plane on the belts and furthermore automatic drive of the loop 12 forming the raised elongated member 11. In order to produce a slight lag of the loop 12 forming the raised member 11 in relation to the conveyor belts 2 of the order of, as noted, 1% to 5%, it is possible for the bend pulley 4 simply to be furnished with a groove in it for the loop 12 to run in. Adjacent to the rear end of the raised member 11 the loop 12 is trained around a bend pulley 13 which is separate from the bend drums 6 for the conveyor belts 2, the diameter of the pulley 13 being so much larger than the diameter of the front bend pulley 4 and the pulley 13 being so placed that there is the desired forwardly sloping alignment of the upper run, forming the raised member 11, of the loop 12 and at the same time even after adjustment in the level of the bend pulley 13 one may be certain that there will be no collision between the lower run of the loop 12 with components extending right over the full width of the device, as for example the crosspiece 9 and the shaft 5. In the illustrated embodiment of the invention the diameter of the bend pulley 13 is about twice as great as that of the front bend pulley 4 or the bend drum 6. The level at which the bend pulley 13 is arranged is in this case such that in a center position both the upper run coming off its outer face of the pulley 13 and also the lower run of the loop 12 running onto its outer surface run out of the plane of the upper and lower runs, respectively, of the conveyor belts 2 with an increase towards the rear, something which makes possible a quite substantial adjustment of the slope of the upper run, forming the member 11, of the loop 12. In the present case as illustrated the bend pulley 13 is placed behind the rear bend drums 6 placed to the back of the conveyor belts 2, something that makes the bend pulley 13 readily accessible so that the design is simple and the raised member is comparatively long.

The bend pulley 13 is free to turn on the shaft 14 which is parallel to the shaft 5 carrying the rear bend drums 6 of the conveyor belts 2. The shaft 14 is carried on a holder 15 for pivoting motion about an axis parallel to the shaft. In the illustrated working example of the invention, the holder 15 comprises a link-like pivot arm, which is clamped onto a rod 16 whose ends are pivoted in support links 17 forming extensions projecting to the rear past the shaft 5. By means of a clamped on operating arm 18 the rod 16 may be rocked to and fro. For this purpose there is a lead screw 20 which engages a pin rotatably mounted on the pivot arm. The lead screw 20 may be turned by means of a handwheel and bears on a support 21 attached to the adjacent carrying link. By turning the lead screw 20 the rod 16 may be pivoted in order to raise the shaft 14 with the bend pulley 13 thereon to a greater or lesser extent. The resulting change in the length of the loop 12 is made possible by the elasticity of the belt material. The lead of the screw on the lead screw 20 may be made such that the screw will not be turned by a force acting on the pin 19. It would however also be possible to have a locking pin or the like to keep the raised member at its set position by acting on the lead screw (20).

I claim:

1. In a delivery device for sheet-like products having at least one conveyor belt defining a conveying plane disposed below a fan wheel which delivers the sheet-like products to the conveyor belt in an overlapping arrangement, the improvement comprising:

at least one bridge aligned in the direction of delivery, said bridge being raised relative to the conveying plane of the conveyor belt and sloped downwardly in the direction of delivery so that its leading edge extends into the conveying plane of the conveyor belt, said bridge being arranged relative to said conveyor belt and said fan wheel such that sheet-like products delivered to said conveyor belt from said fan wheel have a buckled like configuration while in contact with said bridge.

2. The delivery device as claimed in claim 1 wherein said elongated member is centrally placed in said device.

3. The delivery device as claimed in claim 1 comprising means for changing and setting said slope of said elongated member.

4. The delivery device as claimed in claim 1 wherein the distance between the fan wheel axis and said elongated member is so small that said member is at least tangent to a circumferential outline of said fan wheel.

5. The delivery device as claimed in claim 4 wherein said distance is so small that a part of said elongated member is within said circumferential outline.

6. The delivery device as claimed in claim 1 wherein said elongated member is in the form of stationary slat.

7. The delivery device as claimed in claim 1 comprising a belt in the form of a circulatory loop defining an upper and a lower run extending between two loop bend means, said upper run constituting said elongated member and sloping in said delivery direction towards said conveying plane.

8. The delivery device as claimed in claim 7 comprising means for driving said circulatory loop.

9. The delivery device as claimed in claim 8 wherein said driving means is adapted to drive said cirulatory loop at a lower speed than the speed of said at least one conveyor belt.

10. The delivery device as claimed in claim 9 wherein said speed is between 1% and 5% lower than the speed of said conveyor belt.

11. The delivery unit as claimed in claim 7 wherein said conveyor belt is made up of at least two conveyor belt members between which said circulatory loop is placed so as to be flanked thereby, said delivery device further comprising a front bend pulley around which said loop and said conveyor belt are trained, and a rear bend pulley with a larger diameter than the said front bend pulley and being clear of said conveyor belt and having said loop trained about it.

12. The delivery device as claimed in claim 11 wherein said front bend pulley has a groove cut therein to accommodate said loop.

13. The delivery device as claimed in claim 11 comprising a bend drum means and a shaft supporting said drum means, said bend drum means having said conveyor belt trained around it, said rear bend pulley comprising means including a further separate shaft and a holder adapted to pivot around said last-mentioned shaft.

14. The delivery device as claimed in claim 13 wherein said holder comprises pivot arm, a rod to which it is attached, lateral support links on which said rod is pivoted, a lead screw supported adjacent said links, and an operating arm attached to said rod so that said same may be pivoted by said lead screw.

15. The delivery device as claimed in claim 14 comprising a frame, a crosspiece attached to said frame, bearing links clamped on said crosspiece, said bearing links being in the form of rearwardly extending parts of said lateral support links.

* * * * *